US011573518B2

(12) United States Patent
Hara

(10) Patent No.: US 11,573,518 B2
(45) Date of Patent: Feb. 7, 2023

(54) HOUSING PORTION MOUNTING A ROCKER SWITCH WITHIN A SHEET CONVEYING/IMAGE FORMING APPARATUS

(71) Applicant: CANON KABUSHIKI KAISHA, Tokyo (JP)

(72) Inventor: Yoshiaki Hara, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/189,296

(22) Filed: Mar. 2, 2021

(65) Prior Publication Data

US 2021/0286310 A1 Sep. 16, 2021

(30) Foreign Application Priority Data

Mar. 10, 2020 (JP) ..... JP2020-041248

(51) Int. Cl.

| | |
|---|---|
| ***G03G 15/00*** | (2006.01) |
| ***B65H 1/26*** | (2006.01) |
| ***H01H 23/04*** | (2006.01) |
| ***H01H 23/24*** | (2006.01) |
| ***H01H 23/14*** | (2006.01) |

(52) U.S. Cl.

CPC ..... *G03G 15/80* (2013.01); *B65H 1/266* (2013.01); *G03G 15/6502* (2013.01); *H01H 23/04* (2013.01); *H01H 23/14* (2013.01); *H01H 23/24* (2013.01); *G03G 2215/00666* (2013.01)

(58) Field of Classification Search

CPC ..... H01H 23/04; H01H 23/14; H01H 23/24; G03G 15/5016; B65H 2551/00; B65H 2551/14

See application file for complete search history.

(56) References Cited

U.S. PATENT DOCUMENTS 3,671,693 A * 6/1972 Farrell ..... H01H 23/02 200/438
3,713,670 A * 1/1973 Reynolds ..... H01H 21/22 200/295
4,115,673 A * 9/1978 Smith ..... H01H 23/025 200/315
4,816,626 A * 3/1989 Valenzona ..... H01H 15/06 200/548

(Continued)

FOREIGN PATENT DOCUMENTS

JP 2011-244112 A 12/2011

*Primary Examiner* — Vanessa Girardi
(74) *Attorney, Agent, or Firm* — Venable LLP

(57) ABSTRACT

Provided is a sheet conveying apparatus provided with: a rocker switch; a plurality of connectors each connected to two terminals; an outer cover; and a housing portion, wherein the connector among the plurality of connectors which is positioned farthest from the center of the rocker switch in the parallel direction of the two terminals protrudes toward an end portion of the end surface of the rocker switch which is on the connector side, and wherein a wall portion of the housing portion is disposed in a position opposing an end portion on the opposite side from the end portion in the parallel direction and in a position closer, in the direction of insertion of the plurality of connectors into the two terminals, to the rocker switch than the end surfaces of the plurality of connectors on the opposite side from the side where the rocker switch is disposed.

16 Claims, 15 Drawing Sheets

(56) References Cited

U.S. PATENT DOCUMENTS

| | | | | |
|---|---|---|---|---|
| 5,069,439 | A * | 12/1991 | Ise | B65H 31/02 271/213 |
| 7,026,565 | B1 * | 4/2006 | Lee | H01H 23/205 200/5 R |
| 8,433,216 | B2 * | 4/2013 | Ishikake | G03G 15/5016 399/88 |
| 8,626,019 | B2 * | 1/2014 | Amemiya | G03G 15/5016 399/88 |
| 8,829,374 | B2 * | 9/2014 | Uchida | G03G 15/5016 200/294 |
| 2011/0280608 | A1 | 11/2011 | Amemiya et al. | |

* cited by examiner

HOUSING PORTION MOUNTING A ROCKER SWITCH WITHIN A SHEET CONVEYING/IMAGE FORMING APPARATUS

BACKGROUND OF THE INVENTION

Field of the Invention

The present invention relates to a sheet conveying apparatus that includes an image forming apparatus such as an electrophotographic copying machine or an electrophotographic printer (for example, a laser beam printer or an LED printer).

Description of the Related Art

A rocker switch is widely used in an image forming apparatus, which is an apparatus representative of a sheet conveying apparatus provided with a conveying portion that conveys sheets. The rocker switch operates an operation portion to perform a seesaw operation so as to switch on and off the main power supply of the image forming apparatus or the power supply of an electronic component installed in the image forming apparatus. Furthermore, Japanese Patent Laid-Open No. 2011-244112 discloses a configuration in which a mark indicating the direction in which the operation portion is pushed in when switching the power supply on or off is disposed in the vicinity of a rocker switch on the outer cover.

Due to the large number of rocker switches with a bilaterally symmetrical shape, it is not uncommon for a rocker switch to be attached with an orientation which is the opposite of the orientation intended in its design. In cases where a rocker switch is thus attached with an orientation which is the opposite of the intended orientation, the mark disposed in the vicinity of the rocker switch then ends up having the opposite meaning, which may confuse the user and reduce usability.

Moreover, similarly to a rocker switch, there are also a lot of connectors that have a bilaterally symmetrical shape, and it is not uncommon for same to be attached with an orientation which is the opposite of the orientation intended in their design. In cases where a connector is attached in this manner with an orientation which is the opposite of the intended orientation, insertion may prove to be difficult when inserting another connector into the connector, and there is a risk of reduced workability during assembly.

SUMMARY OF THE INVENTION

The present invention desirably provides a sheet conveying apparatus that makes it possible to prevent a rocker switch or a connector from being attached with an orientation which is the opposite of the intended orientation.

A representative configuration of the present invention is a sheet conveying apparatus provided with:

a rocker switch that switches on and off the power supply of the sheet conveying apparatus or of a member installed in the sheet conveying apparatus, the rocker switch having three terminals and an operation portion that is pressed down so as to swing between an on side and an off side;

a plurality of connectors each connected to two of the three terminals of the rocker switch;

an outer cover of the sheet conveying apparatus, the outer cover being provided with a mark indicating the on and/or off of the power supply of the rocker switch; and a housing portion in which the rocker switch is housed, the housing portion having a fitting hole into which the rocker switch is fitted and a wall portion which is disposed, in the direction of insertion of the plurality of connectors into the two terminals, so as to oppose the surface in which the fitting hole is formed and so as to oppose the end surface of the rocker switch on the opposite side from the side where the operation portion is disposed, wherein the connector among the plurality of connectors which is positioned farthest from the center of the rocker switch in a parallel direction of the two terminals protrudes toward an end portion of the end surface of the rocker switch which is on the connector side, and wherein the wall portion is disposed in a position opposing an end portion on the opposite side from the end portion of the end surface of the rocker switch in the parallel direction of the two terminals and in a position closer, in the insertion direction, to the rocker switch than the end surfaces of the plurality of connectors on the opposite side from the side where the rocker switch is disposed.

Further features of the present invention will become apparent from the following description of exemplary embodiments with reference to the attached drawings.

DESCRIPTION OF THE EMBODIMENTS

First Embodiment

<Image Forming Apparatus>

The overall configuration of an image forming apparatus constituting a sheet conveying apparatus according to a first embodiment of the present invention will first be described hereinbelow with reference to the drawings, together with the operation during image formation. Note that the dimensions, material properties, shapes, and relative arrangement, and the like, of the constituent components described hereinbelow do not, unless specified otherwise, limit the scope of the invention thereto.

An image forming apparatus A according to the present embodiment is an intermediate tandem-type image forming apparatus that forms an image by transferring toner in four colors, namely, yellow (Y), magenta (M), cyan (C), and black (K) to an intermediate transfer belt and then transferring an image to a sheet. Note that, in the following description, although Y, M, C, and K are assigned as subscripts to the members using the toners of each of the foregoing colors, the configurations and operations of each member are substantially the same except for the fact that the colors of the toners being used are different, and hence the subscripts are suitably omitted except in cases where differentiation is required.

Figure 1:
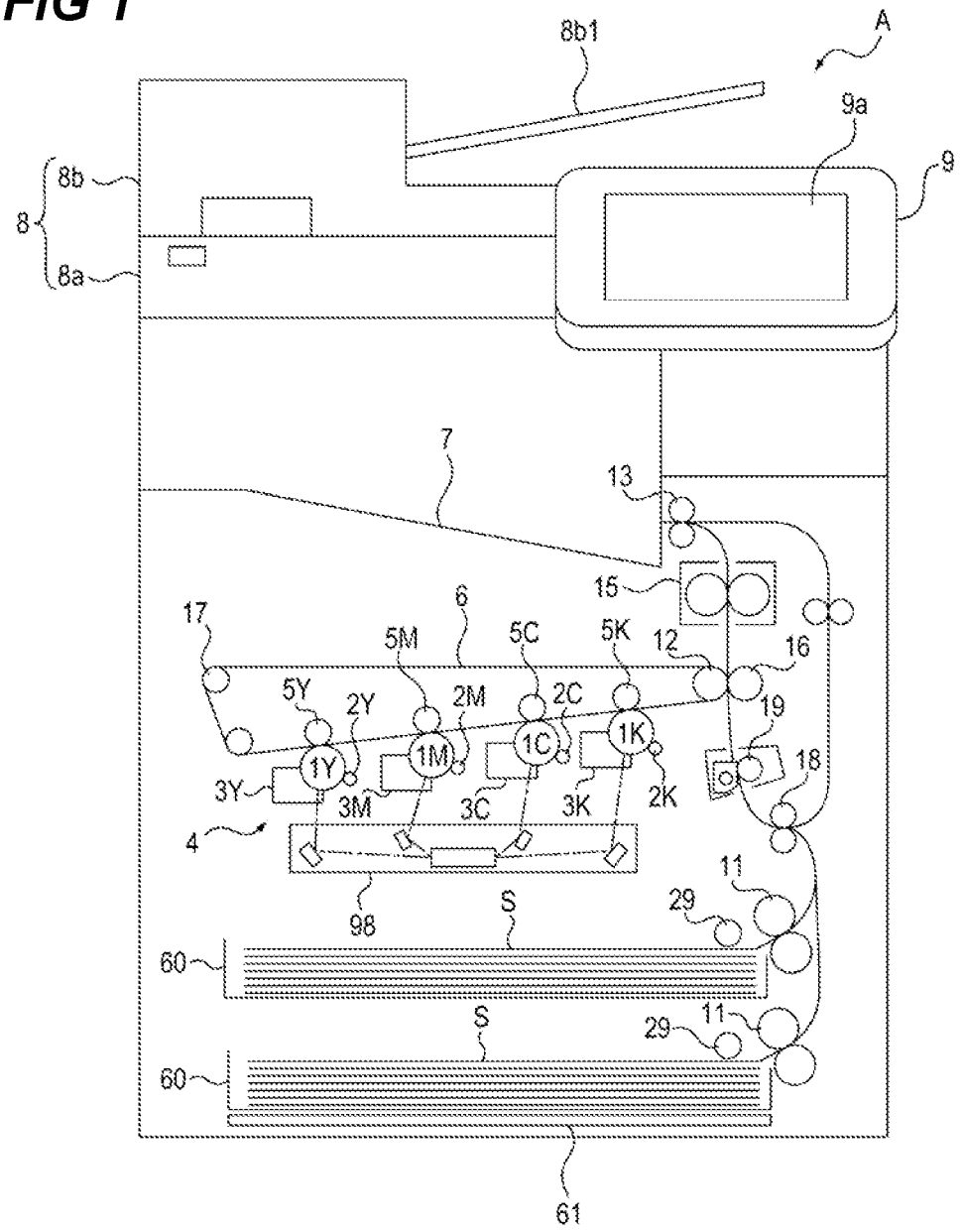
FIG. 1 is a cross-sectional schematic diagram of an image forming apparatus.

FIG. 1 is a cross-sectional schematic diagram of the image forming apparatus A. As illustrated in FIG. 1, the image forming apparatus A is provided with an image forming portion 4 that forms an image on a sheet S. The image forming portion 4 is provided with photosensitive drums 1 (1Y, 1M, 1C, and 1K), charging rollers 2 (2Y, 2M, 2C, and 2K), and developing apparatuses 3 (3Y, 3M, 3C, and 3K). The image forming portion 4 is also provided with primary transfer rollers 5 (5Y, 5M, 5C, and 5K), a laser scanner unit 98, an intermediate transfer belt 6, a secondary transfer roller 16, a secondary transfer counter roller 12, and a drive roller 17.

The image forming apparatus A is also provided with an image reading portion 8 that reads an original image. The image reading portion 8 is configured from a reader 8*a* and an ADF 8*b*. The reader 8*a* uses an image pickup element (not illustrated) such as a CCD to read the original image, which has been placed on a placing table (not illustrated) formed from a glass plate, and converts the image to image data. The ADF 8*b* automatically conveys the original which has been loaded into a manuscript tray 8*b*1 and reads the image. The ADF 8*b* is turnably supported, and the ADF 8*b* can be turned so as to open upward to enable access to the placing table of the reader 8*a*.

The image forming apparatus A is also provided with a sheet cassette 60 for storing a sheet S whereon an image is formed. A cassette heater 61 which heats the sheet S stored in the sheet cassette 60 so as to dry the sheet S is disposed in the vicinity of the sheet cassette 60. By using the cassette heater 61 to dry the sheet S in this manner, bending of the sheet S during image formation is suppressed.

Further, a touch panel-type operation panel 9 for making image formation-related settings and the like is disposed on the front side of the image forming apparatus A. Keys for inputting various information and numerical values are displayed on a display 9*a* of the operation panel 9. By operating the keys displayed on the display 9*a* to input the numerical values, the user is able to set the number of images to be formed and make image reading-related settings.

Next, image forming operations by the image forming apparatus A will be described. When an image is to be formed, an image formation job signal is first input to the controller (not illustrated). Accordingly, the sheet S stored in the sheet cassette 60 is picked up by the pick roller 29 and is conveyed to a registration roller 19 by a transport roller 11 and a conveying roller 18. Next, the sheet S is fed, with predetermined timing by the registration roller 19, into a secondary transfer portion that is formed from the secondary transfer roller 16 and the secondary transfer counter roller 12.

Meanwhile, the surface of the photosensitive drum 1Y is first charged in the image forming portion 4 by the charging roller 2Y. Thereafter, the laser scanner unit 98 irradiates the surface of the photosensitive drum 1Y with laser light according to an image signal of the original image read by the image reading portion 8, and forms an electrostatic latent image on the surface of the photosensitive drum 1Y. Subsequently, the yellow toner is made by the developing apparatus 3Y to adhere to the electrostatic latent image formed on the surface of the photosensitive drum 1Y, thereby forming a yellow toner image on the surface of the photosensitive drum 1Y. Due to a primary transfer bias being applied to the primary transfer roller 5Y, the toner image formed on the surface of the photosensitive drum 1Y undergoes primary transfer to the intermediate transfer belt 6.

Through a similar process, magenta, cyan, and black toner images are also formed on the photosensitive drums 1M, 1C, and 1K. Further, due to a primary transfer bias being applied to the primary transfer rollers 5M, 5C, and 5K, toner images thereof are transferred in a superposed manner to the yellow toner image on the intermediate transfer belt 6. A full-color toner image which corresponds to the image signal is thus formed on the surface of the intermediate transfer belt 6.

Thereafter, because the intermediate transfer belt 6 moves in a circular manner due to a driving force being transmitted from the drive roller 17, the full-color toner image is fed to the secondary transfer portion. Further, due to a secondary transfer bias being applied by the secondary transfer portion to the secondary transfer roller 16, the full-color toner image on the intermediate transfer belt 6 is transferred to the sheet S.

Next, the sheet S to which the toner image has been transferred undergoes heating and pressurization in a fixing apparatus 15, thereby fixing the toner image on the sheet S to the sheet S. Subsequently, the sheet S with the fixed toner image is discharged by a discharge roller 13 to a discharge portion 7.

<Power Supply Switch>

Next, the configuration of a power supply switch 70 that switches on and off the power supply of the cassette heater 61 will be described.

Figure 2A:
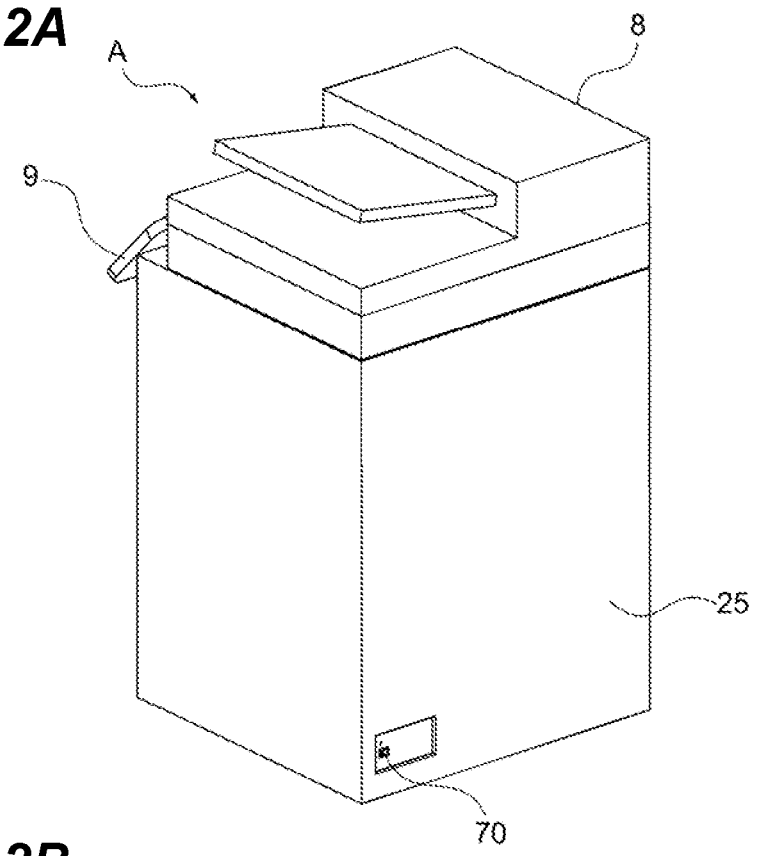
FIGS. 2A and 2B are perspective views of the image forming apparatus from the back side thereof.
Figure 2B:
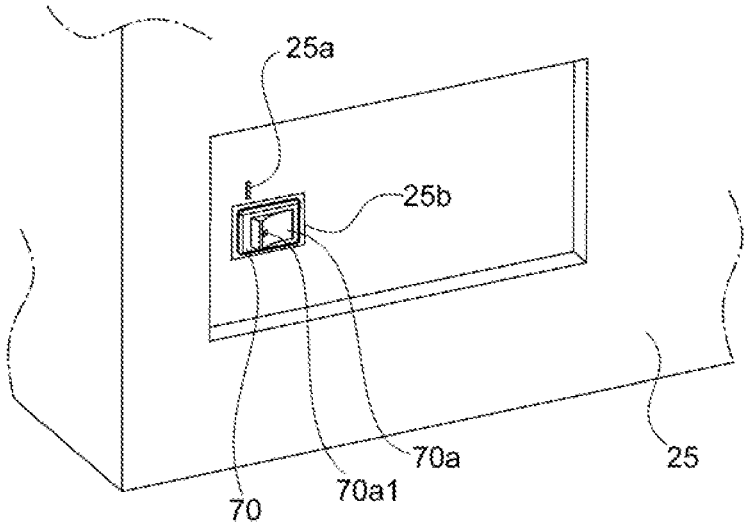

FIG. 2A is a perspective view of the image forming apparatus A from the back side thereof. FIG. 2B is an enlarged view of the power supply switch 70. As illustrated in FIGS. 2A and 2B, the power supply switch 70 is a rocker switch that, when an operation portion 70*a* is operated, performs a seesaw operation so as to switch the power supply on and off. The rocker switch is a mechanism that swings in both the on-side and off-side directions.

The power supply switch 70 is disposed such that the operation portion 70*a* is exposed via an opening 25*b* in an outer cover 25 on the back side of the image forming apparatus A. A print 70*a*1 (another mark) which is a mark indicating the on side of the power supply is provided on the surface of the operation portion 70*a*. Also provided, in the vicinity of the opening 25*b* in the outer cover 25, is a marking 25*a*, which is a mark indicating the direction in which the operation portion 70*a* is to be pressed in when switching on the power supply of the power supply switch 70.

When the power supply switch 70 is attached with the correct orientation, the side of the operation portion 70*a* where the print 70*a*1 is provided is pressed in on the marking 25*a* side of the outer cover 25, thereby turning on the power supply of the cassette heater 61. Note that the print 70*a*1 of the operation portion 70*a* may also be a marking, and that the marking 25*a* of the outer cover 25 may also be a print. Furthermore, the print 70*a*1 of the operation portion 70*a* and the marking 25*a* of the outer cover 25 may also be configured to indicate the direction in which the operation portion

70*a* is pressed in when switching off the power supply of the power supply switch 70. Additionally, the print 70*a*1 of the operation portion 70*a* and the marking 25*a* of the outer cover 25 may be configured to have either one or both of the words "on" and "off". The shape of the marks preferably have shapes that are easily discriminated by the user as on or off, such as a circular mark to indicate the on side and a minus-sign mark to indicate the off side.

Figure 3:
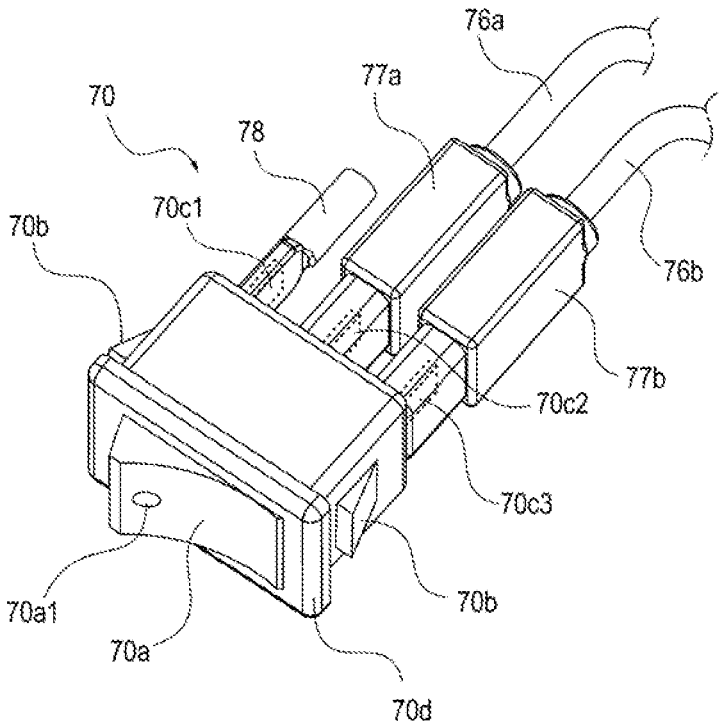
FIG. 3 is a perspective view of a power supply switch.

FIG. 3 is a perspective view of the power supply switch 70. As illustrated in FIG. 3, the power supply switch 70 has an operation portion 70*a* that is operated when switching the power supply on and off, three terminals 70*c*1 to 70*c*3, and a retaining portion 70*b* (a restricting portion) formed of an elastic body. In the case of the three terminals 70*c*1 to 70*c*3, it is possible to optionally set either one of the rocking sides of the operation portion 70*a* to the on side or the off side of the power supply by selectively using two terminals from among these three terminals. Among the three terminals 70*c*1 to 70*c*3, connectors 77*a* and 77*b*, which are attached to the end portions of cables 76*a* and 76*b*, are connected to the two terminals 70*c*2 and 70*c*3. Furthermore, a protective rubber tube 78, which is shorter in length than the connectors 77*a* and 77*b*, is attached to the terminal 70*c*1. Note that, for a case where the connectors 77*a* and 77*b* are connected to the terminals 70*c*1 and 70*c*2, and a case where the connectors 77*a* and 77*b* are connected to the terminals 70*c*2 and 70*c*3, the relationship between such cases when the operation portion 70*a* is pressed in on one side is the opposite in terms of whether the power supply is then on or off. Conversely, when the connectors 77*a* and 77*b* are connected to the terminals 70*c*1 and 70*c*2, the protective rubber tube 78 is attached to the terminal 70*c*3.

Figure 4:
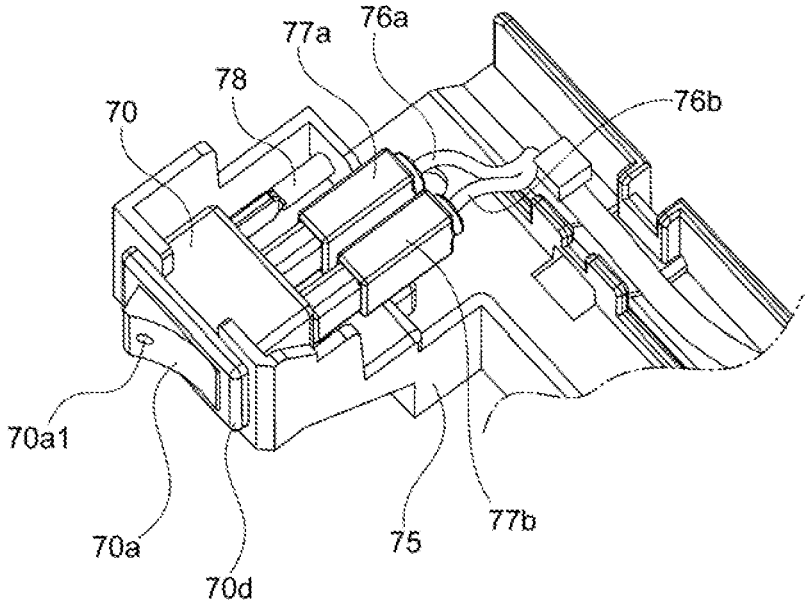
FIG. 4 is a perspective view of the neighborhood of the power supply switch of the image forming apparatus.

FIG. 4 is a perspective view of the neighborhood of the power supply switch 70 in a state where the outer cover 25 of the image forming apparatus A has been removed. As illustrated in FIG. 4, the power supply switch 70 is attached so as to be housed in a holder 75 (a housing portion) that is formed using a mold. When the power supply switch 70 is attached to the holder 75, the operation portion 70*a* of the power supply switch 70 is disposed exposed to the outside of the holder 75, and the terminals 70*c*1 to 70*c*3 are arranged inside the holder 75.

Figure 5A:
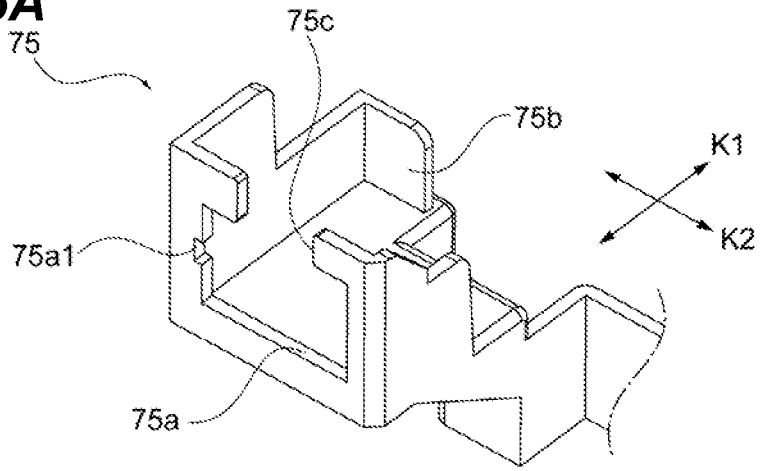
FIGS. 5A to 5C are perspective view, front elevation, and top view of a holder.
Figure 5B:
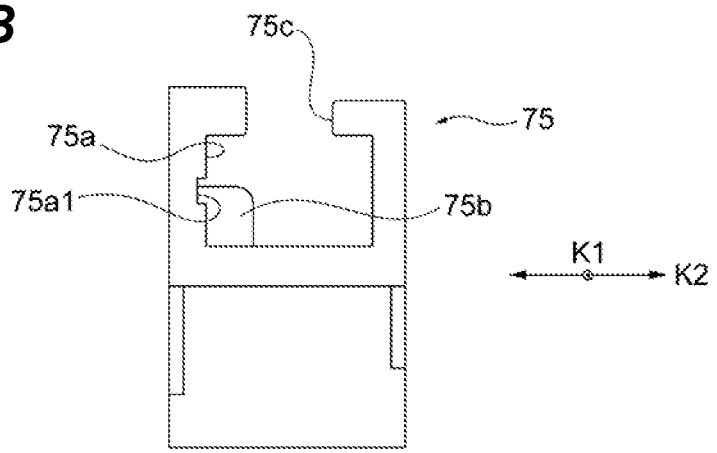
Figure 5C:
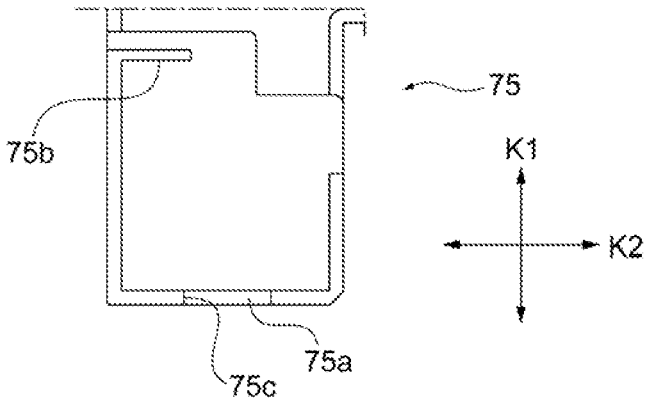

FIG. 5A is a perspective view of the holder 75. FIG. 5B is a front elevation of the holder 75. FIG. 5C is a top view of the holder 75. As illustrated in FIGS. 5A to 5C, the holder 75 has a rectangular fitting hole 75*a* into which the power supply switch 70 is fitted and that penetrates in the direction of the arrow K1, which is the direction of insertion of the connectors 77*a* and 77*b* into the terminals 70*c*2 and 70*c*3. Furthermore, a cutout 75*c* for passing through the cables 76 when the power supply switch 70 is attached is formed at the top of the fitting hole 75*a* in the holder 75 so as to communicate with the fitting hole 75*a*.

A recess 75*a*1, which is recessed on the side of the operation portion 70*a* where the print 70*a*1 is disposed, is also formed in the inner wall of the fitting hole 75*a* in the direction of the arrow K2, which is the direction parallel to the terminals 70*c*1 to 70*c*3. When attaching the power supply switch 70, the power supply switch 70 is attached with the correct orientation by attaching the print 70*a*1 of the operation portion 70*a* so as to be positioned on the recess 75*a*1 side.

Furthermore, the holder 75 has a rib 75*b* (a wall portion) in a position opposing the surface where the fitting hole 75*a* is formed in the direction of the arrow K1. The rib 75*b* also opposes an end surface 70*x* (see FIG. 6) of the power supply switch 70 on the opposite side from the side where the operation portion 70*a* is disposed. The rib 75*b* is also disposed in a position overlapping part of the fitting hole 75*a* in the direction of the arrow K1. The function of the rib 75*b* will be described subsequently.

<Power Supply Switch Attachment Method>

Next, a method for attaching the power supply switch 70 to the holder 75 will be described.

Figure 6A:
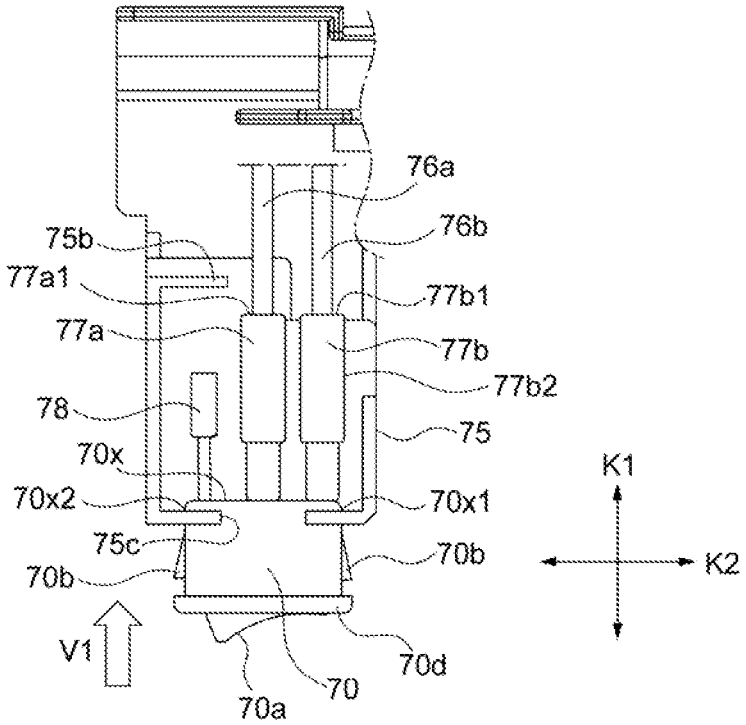
FIGS. 6A and 6B are top views of the power supply switch and the holder.
Figure 6B:
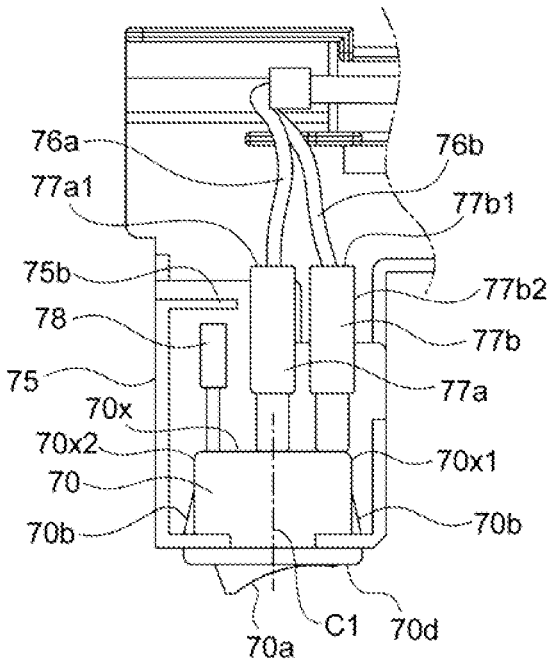

FIG. 6A is a top view of the power supply switch 70 and the holder 75 while the power supply switch 70 is being attached. FIG. 6B is a top view of the power supply switch 70 and the holder 75 after attaching the power supply switch 70.

As illustrated in FIGS. 6A and 6B, when attaching the power supply switch 70 to the holder 75, the operator first connects the connectors 77*a* and 77*b* attached at one end of the cables 76*a* and 76*b* to the terminals 70*c*2 and 70*c*3 of the power supply switch 70. Next, the operator passes the cables 76 through the cutout 75*c* in the holder 75 and moves the power supply switch 70 to the position of the fitting hole 75*a* in the holder 75. At such time, the operator orients the print 70*a*1 of the operation portion 70*a* and the recess 75*a*1 in the holder 75 so that their positions are aligned.

Next, the operator presses in the power supply switch 70 in the direction of the arrow V1 illustrated in FIG. 6A up to a position in which a butting portion 70*d* formed on the outer perimeter of the operation portion 70*a* of the power supply switch 70 butts against the holder 75. Thus, sections of the power supply switch 70 other than the operation portion 70*a* enter inside the holder 75 from the fitting hole 75*a*, and the power supply switch 70 is fitted into the fitting hole 75*a*. At such time, the retaining portion 70*b* of the power supply switch 70 is compressed through elastic deformation while abutting the inner wall of the fitting hole 75*a*, and when the power supply switch 70 moves to the position in which same is fitted into the fitting hole 75*a*, the retaining portion 70*b* is restored so as to abut the surface where the fitting hole 75*a* in the holder 75 is formed. The retaining portion 70*b* thus regulates disengagement of the power supply switch 70 fitted in the fitting hole 75*a*. The power supply switch 70 is thus attached.

Here, when the power supply switch 70 is fitted in the fitting hole 75*a*, an end surface 77*b*2 of the connector 77*b*, which is positioned farthest from the center of the power supply switch 70 in the direction of the arrow K2, protrudes toward an end portion 70*x*1 of the end surface 70*x* of the power supply switch 70 which is on the connector 77*b* side. Furthermore, the rib 75*b* is disposed in a position opposing an end portion 70*x*2 of the end surface 70*x* of the power supply switch 70 on the opposite side from the end portion 70*x*1 in the direction of the arrow K2. Moreover, the rib 75*b* is disposed in a position closer, in the direction of the arrow K1, to the power supply switch 70 than end surfaces 77*a*1 and 77*b*1 of the connectors 77*a* and 77*b* on the opposite side from the side where the power supply switch 70 is disposed. Note that line C1 illustrated in FIG. 6B is the center line of the power supply switch 70 in the direction of the arrow K2.

Figure 7:
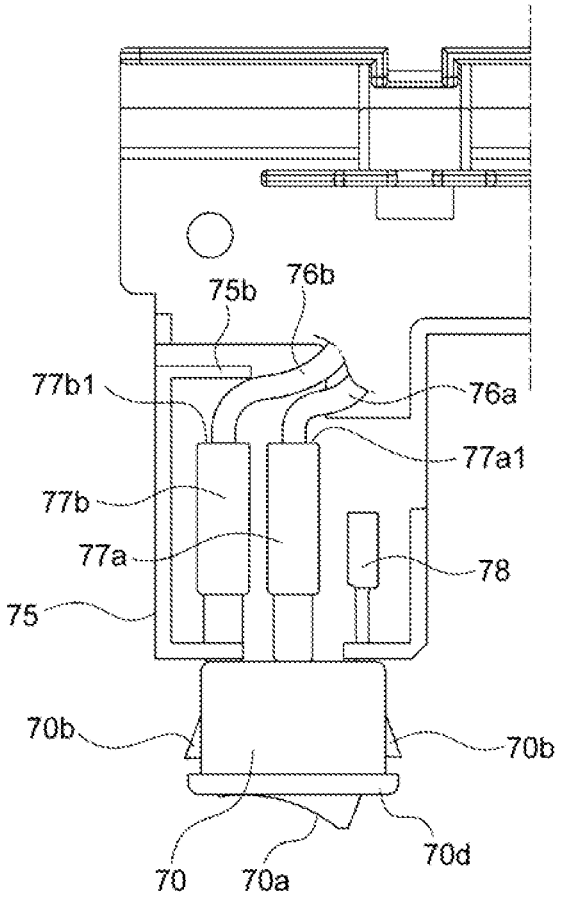
FIG. 7 is a top view of the power supply switch and the holder.

By disposing the rib 75*b* in this manner, the connectors 77 or cables 76 butt against and interfere with the rib 75*b* when the power supply switch 70 is pressed in in the direction of the arrow V1 so as to enter inside the holder 75 from the fitting hole 75*a* with an orientation which is the opposite of the foregoing orientation, as illustrated in FIG. 7. Hence, it is not possible to press in the power supply switch 70 up to the position in which the butting portion 70*d* butts against the holder 75, and it is not possible to attach the power supply switch 70 by fitting the power supply switch 70 into the fitting hole 75*a*. It is therefore possible to prevent the power supply switch 70 from being attached with an orientation which is the opposite of the intended orientation. Hence, the correct relationship between the marking 25*a* of the outer cover 25 and the direction in which the operation portion 70*a* is pressed in as indicated by the marking 25*a* can be established, and erroneous operation of the power supply switch 70 can be suppressed.

Second Embodiment

Next, a second embodiment of the image forming apparatus constituting the sheet conveying apparatus according to the present invention will be described using the drawings. Note that the same reference signs are assigned to those parts for which the descriptions overlap with the first embodiment, and descriptions thereof are omitted.

Figure 8A:
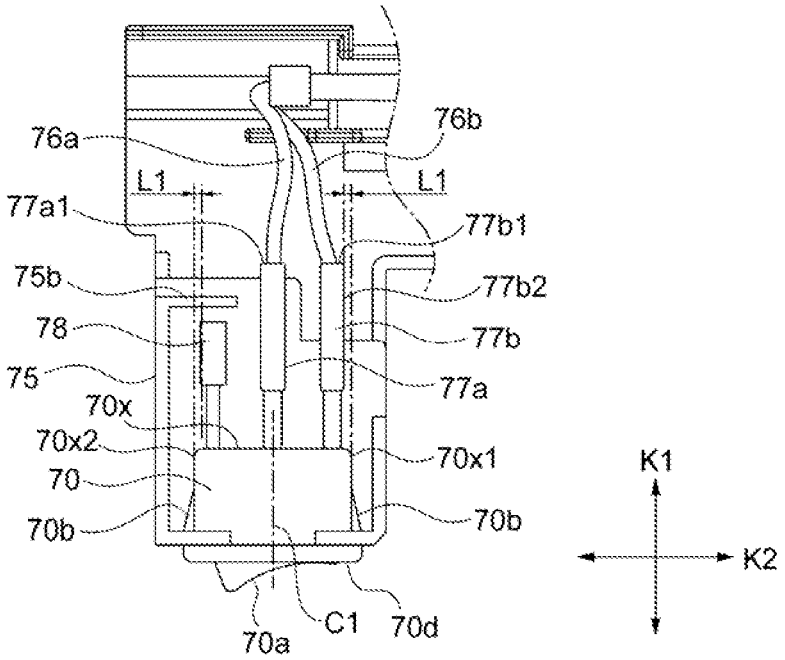
FIGS. 8A and 8B are top views of the power supply switch and the holder.
Figure 8B:
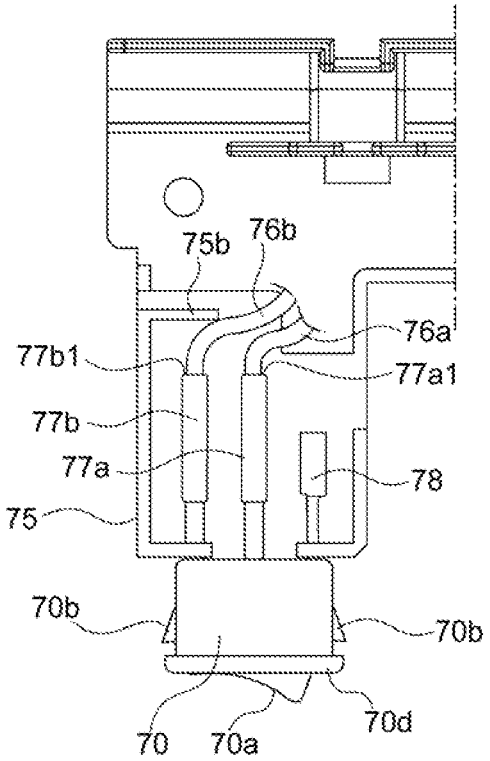

FIG. 8 is a top view of the power supply switch 70 and the holder 75 according to this embodiment. FIG. 8A illustrates a state where the power supply switch 70 has been attached with the intended orientation. FIG. 8B illustrates a state where the power supply switch 70 has been attached with an orientation which is the opposite of the intended orientation. As illustrated in FIGS. 8A and 8B, in the configuration of this embodiment, the connectors 77*a* and 77*b* have widths in the direction of the arrow K2 that are different from those of the configuration of the first embodiment, but the other configurations are similar.

In this embodiment, when the power supply switch 70 is fitted in the fitting hole 75*a*, the connector 77*b* of the power supply switch 70 is positioned, in the direction of the arrow K2, more toward the center of the power supply switch 70 than the end portion 70*x*1 of the end surface 70*x* of the power supply switch 70 on the connector 77*b* side. The distance, in the direction of the arrow K2, between the end portion 70*x*1 of the end surface 70*x* of the power supply switch 70 and an end surface 77*b*2 of the connector 77*b* is L1.

Furthermore, when the power supply switch 70 is fitted in the fitting hole 75*a*, the rib 75*b* extends toward the center of the power supply switch 70 in the direction of the arrow K2 by a distance greater than or equal to a distance L1 from the position in which the end surface 70*x* of the power supply switch 70 opposes the end portion 70*x*2. Moreover, the rib 75*b* is disposed in a position closer, in the direction of the arrow K1, to the power supply switch 70 than end surfaces 77*a*1 and 77*b*1 of the connectors 77*a* and 77*b* on the opposite side from the side where the power supply switch 70 is disposed.

By disposing the rib 75*b* in this manner, the connectors 77 butt against and interfere with the rib 75*b* when the power supply switch 70 is pressed in in the direction of the arrow K1 so as to enter inside the holder 75 from the fitting hole 75*a* with an orientation which is the opposite of the intended orientation, as illustrated in FIG. 8B. Hence, it is not possible to press in the power supply switch 70 up to the position in which the butting portion 70*d* butts against the holder 75, and it is not possible to attach the power supply switch 70 by fitting power supply switch 70 into the fitting hole 75*a*. It is therefore possible to prevent the power supply switch 70 from being attached with an orientation which is the opposite of the intended orientation.

Third Embodiment

Next, a third embodiment of the image forming apparatus constituting the sheet conveying apparatus according to the present invention will be described using the drawings. Note that the same reference signs are assigned to those parts for which the descriptions overlap with the first embodiment, and descriptions thereof are omitted.

Figure 9A:
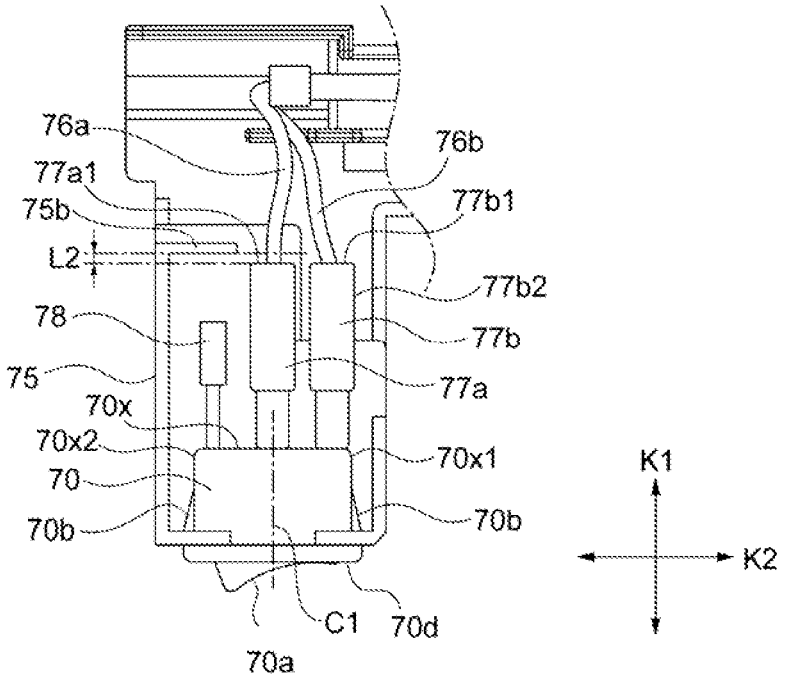
FIGS. 9A and 9B are top views of the power supply switch and the holder.
Figure 9B:
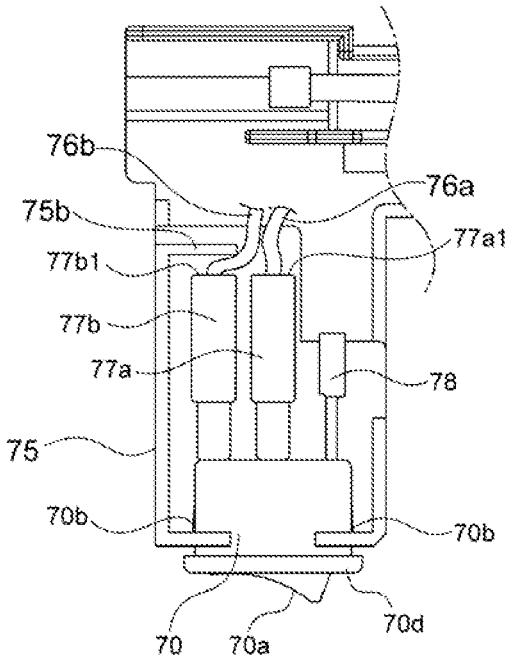

FIG. 9 is a top view of the power supply switch 70 and the holder 75 according to this embodiment. FIG. 9A illustrates a state where the power supply switch 70 has been attached with the intended orientation. FIG. 9B illustrates a state where the power supply switch 70 has been attached with an orientation which is the opposite of the intended orientation. As illustrated in FIGS. 9A and 9B, in the configuration of this embodiment, the rib 75*b* of the holder 75 has a different position from that of the configuration of the first embodiment, but the other configurations are similar.

More specifically, the rib 75*b* of the holder 75 is disposed in a position opposing an end portion 70*x*2 of the end surface 70*x* of the power supply switch 70 on the opposite side from the end portion 70*x*1 in the direction of the arrow K2. Moreover, the rib 75*b* is disposed between the end surfaces 77*a*1 and 77*b*1 of the connectors 77*a* and 77*b* on the opposite side from the side where the power supply switch 70 is disposed in the direction of the arrow K1, and a position separated by a distance L2 from the end surfaces 77*a*1 and 77*b*1 in the direction of separation from the power supply switch 70. Here, in this embodiment, L2 is set to equal 15 mm.

By disposing the rib 75*b* in this manner, the cables 76 butt against and interfere with the rib 75*b* when the power supply switch 70 is pressed in in the direction of the arrow K1 so as to enter inside the holder 75 from the fitting hole 75*a* with an orientation which is the opposite of the intended orientation, as illustrated in FIG. 9B. Thus, it is not possible to press in the power supply switch 70 up to the position in which the butting portion 70*d* butts against the holder 75, and it is not possible to attach the power supply switch 70 by fitting the power supply switch 70 into the fitting hole 75*a*. It is therefore possible to prevent the power supply switch 70 from being attached with an orientation which is the opposite of the intended orientation.

Note that the configuration of this embodiment may also be applied to the configuration of the second embodiment. In other words, in the configuration of the second embodiment, the rib 75*b* is installed in a position between the end surfaces 77*a*1 and 77*b*1 of the connectors 77*a* and 77*b* on the opposite side from the side where the power supply switch 70 is disposed in the direction of the arrow K1, and a position separated by the distance L1 from the end surfaces 77*a*1 and 77*b*1. It is therefore possible to prevent the power supply switch 70 from being attached with an orientation which is the opposite of the intended orientation.

Furthermore, although a configuration in which the power supply of the cassette heater 61 is switched on and off by the power supply switch 70 was described in the first to third embodiments, the present invention is not limited to or by this configuration. In other words, the foregoing advantageous effects can also be obtained with a configuration in which all the power supplies of the image forming apparatus A (the main power supply) and the power supplies of members other than the cassette heater 61 which are installed in the image forming apparatus A are switched on and off by means of the power supply switch 70.

Furthermore, the power supply switch 70 disclosed in the first to third embodiments may also be applied to a switch that is connected to the image forming apparatus A and that, in addition to the image forming apparatus A, turns on and off the power supplies of optional apparatuses constituting the image forming system. Examples of optional apparatuses include: a sheet deck which is connected in the width direction of the image forming apparatus A separately from the sheet cassette 60 provided to the image forming apparatus A, or a post-processing apparatus which is connected to the image forming apparatus A in order to perform binding or the like. An image forming system 500 wherein these optional apparatuses are installed will be described hereinbelow.

Figure 15:
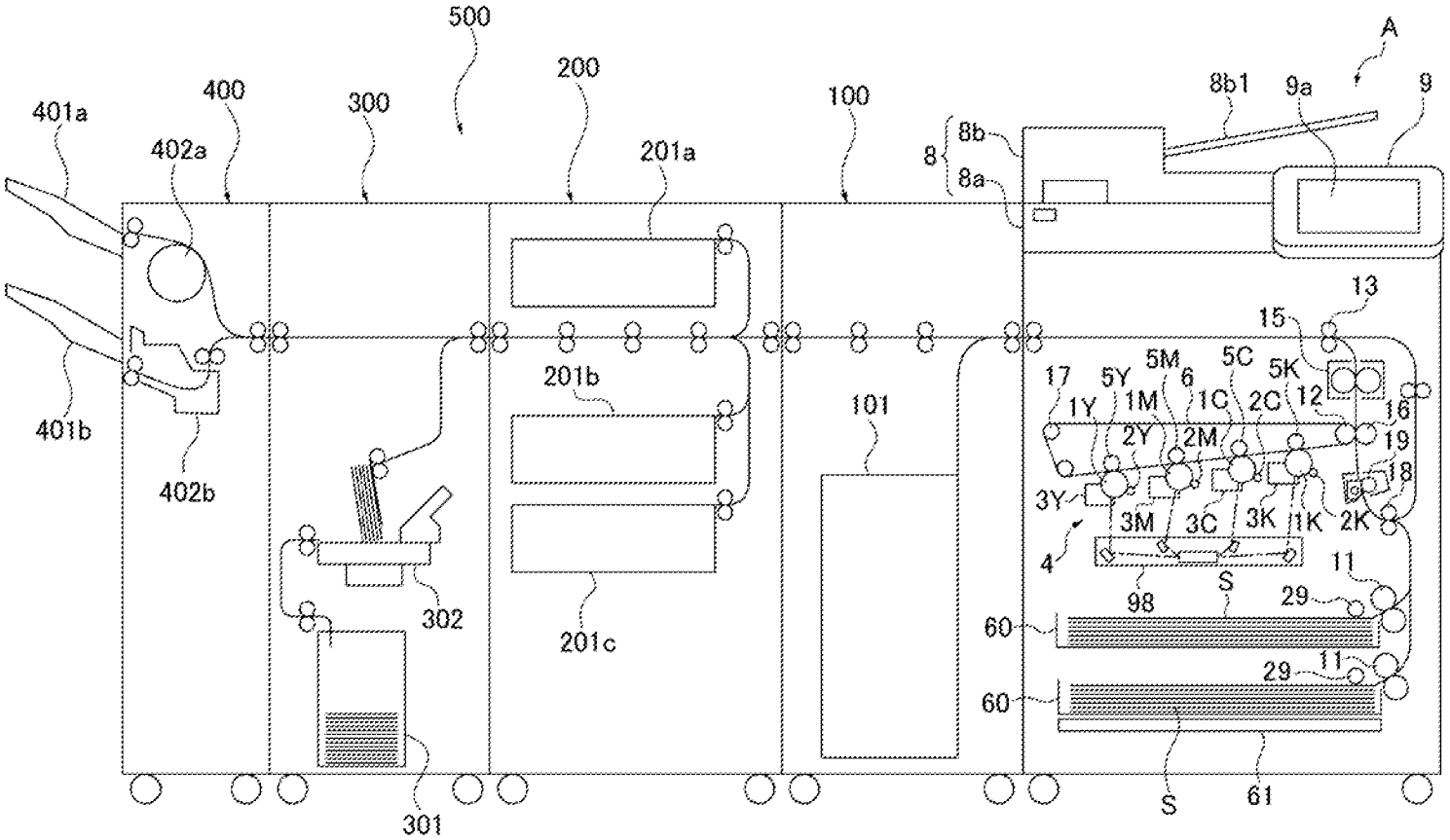
FIG. 15 is a cross-sectional schematic diagram of an image forming system.

FIG. 15 is a cross-sectional schematic diagram of the image forming system 500. As illustrated in FIG. 3, the image forming system 500 is configured from the image forming apparatus A, a high-capacity stacker 100, an inserter 200, a glue binding machine 300, and a saddle stitching machine 400. These apparatuses are selectively used according to instructions from a controller (not illustrated) which receives jobs from a user.

The high-capacity stacker 100 loads sheets S which have images formed by the image forming apparatus A into a stacker tray 101. Casters (not illustrated) are attached to the stacker tray 101, enabling the user to use the casters to easily move a large amount of sheets S loaded in the stacker tray 101.

The inserter 200 is a sheet deck constituting an optional apparatus which is connected in the width direction of the image forming apparatus A. The inserter 200 has sheet cassettes 201*a*, 201*b*, and 201*c*. The inserter 200 feeds the sheets S stored in the sheet cassettes 201*a*, 201*b*, and 201*c* to the glue binding machine 300 and the saddle stitching machine 400.

The glue binding machine 300 is a post-processing apparatus constituting an optional apparatus which is connected to the image forming apparatus A in order to perform binding and the like. The glue binding machine 300 performs, in a binding portion 302, glue binding processing such as natural-glue binding processing or case binding processing of sheets S which have images formed by the image forming apparatus A and sheets S fed from the inserter 200. The sheets S which have undergone glue binding processing by the glue binding machine 300 are discharged to a discharge tray 301.

The saddle stitching machine 400 is a post-processing apparatus constituting an optional apparatus which is connected to the image forming apparatus A in order to perform binding and the like. The saddle stitching machine 400 performs, in a processing portion 402a and a binding portion 402b, processing such as saddle stitching, punching, cutting, shift paper discharge, and folding of sheets S which have images formed by the image forming apparatus A and sheets S fed from the inserter 200. Sheets S which have undergone the saddle stitching by the saddle stitching machine 400 are discharged to discharge trays 401*a* and 401*b*.

Here, the image forming apparatus A, the high-capacity stacker 100, inserter 200, the glue binding machine 300, and the saddle stitching machine 400 that constitute the image forming system 500 are sheet conveying apparatuses which are each provided with a conveying portion for conveying the sheets S. In other words, here, sheet conveying apparatuses comprise the image forming apparatus A, high-capacity stacker 100, inserter 200, glue binding machine 300, and saddle stitching machine 400. In other words, the foregoing advantageous effects can also be obtained with a configuration in which all the power supplies of the sheet conveying apparatuses (the main power supply) and the power supplies of members which are installed in the sheet conveying apparatuses are switched on and off by means of the power supply switch 70 of the first to third embodiments.

Fourth Embodiment

Next, a fourth embodiment of the image forming apparatus constituting the sheet conveying apparatus according to the present invention will be described using the drawings. Note that the same reference signs are assigned to those parts for which the descriptions overlap with the first embodiment, and descriptions thereof are omitted.

This embodiment describes an attachment configuration of a connector 80 that integrally holds a plurality of cables 86*a* to 86*d* for electrically connecting the cassette heater 61 to a power supply substrate (not illustrated), the plurality of cables 86*a* to 86*d* being held at one end thereof. The power supply substrate (not illustrated) is provided with a transformer and receives a supply of power from a commercial power supply, and generates power which is used by the cassette heater 61 and the other devices and supplies this power to these devices.

Figure 10:
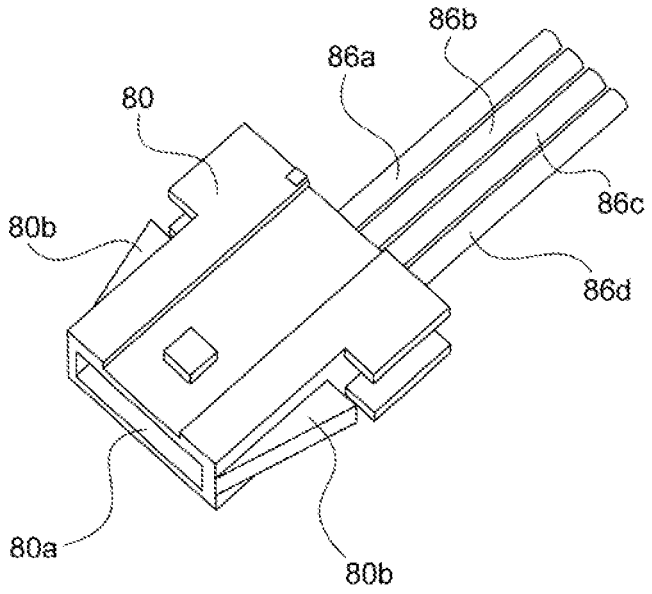
FIG. 10 is a perspective view of a connector.

FIG. 10 is a perspective view of the connector 80. As illustrated in FIG. 10, the connector 80 is attached to the end portions of the plurality of cables 86*a* to 86*d* and has an insertion opening 80*a* into which a connector (another connector) which is not illustrated is inserted, a retaining portion 80*b* (restricting portion) formed of an elastic body, and seven terminals (not illustrated). The cables 86*a* to 86*d* are connected at their ends to four terminals from among the seven terminals in the connector 80. The connector 80 has a symmetrical shape in the parallel direction of the seven terminals.

Figure 11:
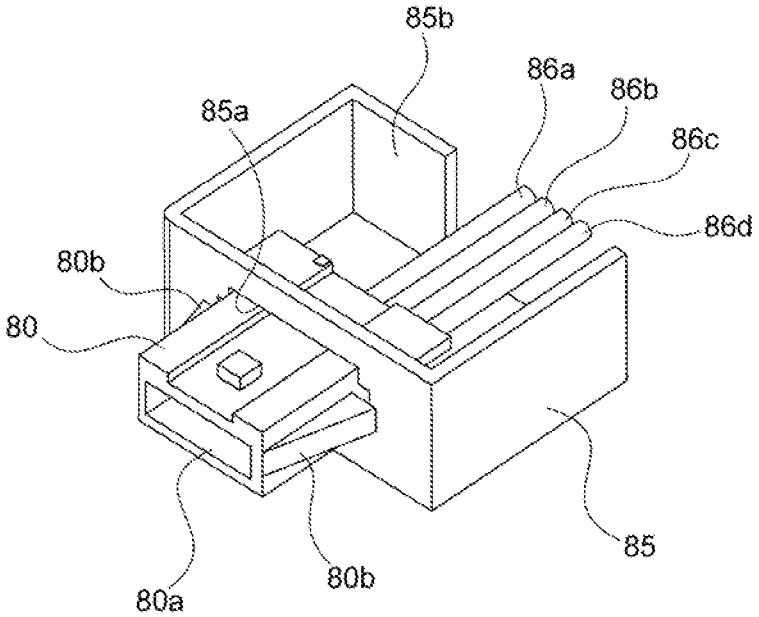
FIG. 11 is a perspective view of the neighborhood of the connector of the image forming apparatus.
Figure 12A:
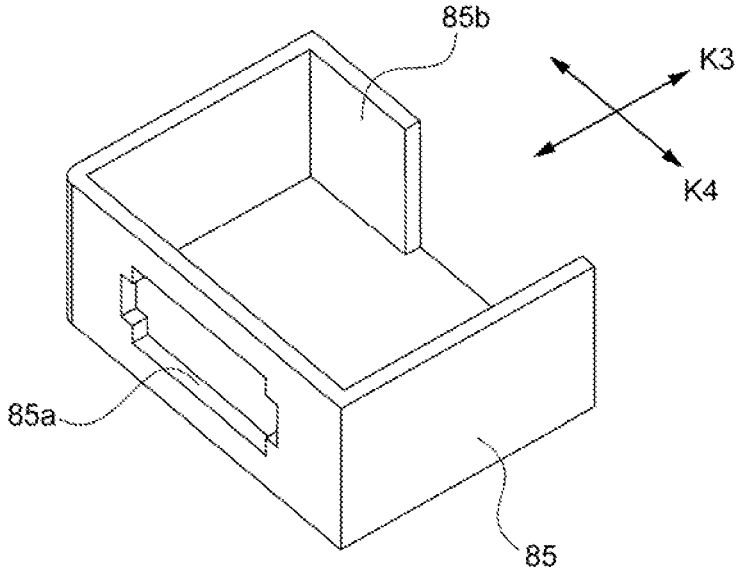
FIGS. 12A and 12B are perspective views of the holder.
Figure 12B:
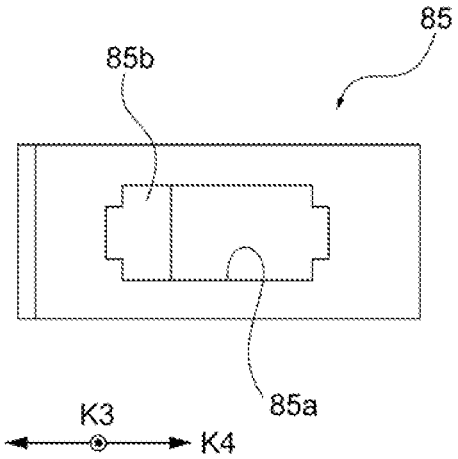

FIG. 11 is a perspective view of the neighborhood of the connector 80 of the image forming apparatus A. FIGS. 12A and 12B are perspective views of the holder 85. As illustrated in FIGS. 11, 12A and 12B, the connector 80 is attached so as to be housed in the holder 85. The holder 85 has a fitting hole 85*a* formed therein in which the connector 80 is fitted and which penetrates the holder in the direction (the direction of the arrow K3) in which another connector is inserted into the insertion opening 80*a* of the connector 80. The fitting hole 85*a* has a symmetrical shape in the parallel direction (the direction of the arrow K4) of the seven terminals of the connector 80.

Furthermore, a rib 85*b* is formed in the holder 85 in a position opposing the fitting hole 85*a* in the direction of the arrow K4. The rib 85*b* also opposes an end surface 80*x* (see FIG. 13) of the connector 80 on the opposite side from the side where the insertion opening 80*a* is disposed in the direction of the arrow K3. The rib 85*b* is also disposed in a position overlapping part of the fitting hole 85*a* in direction of the arrow K3. The function of the rib 85*b* will be described subsequently.

Figure 13A:
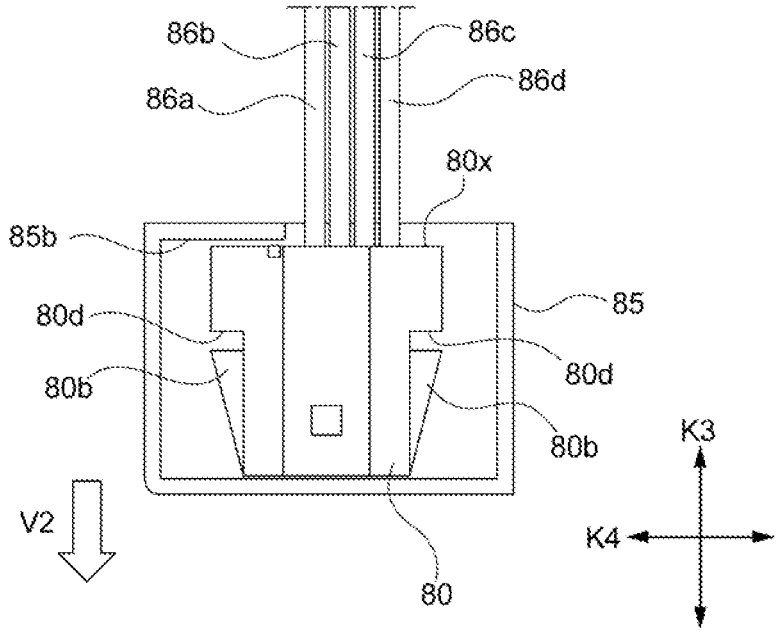
FIGS. 13A and 13B are top views of the connector and the holder.
Figure 13B:
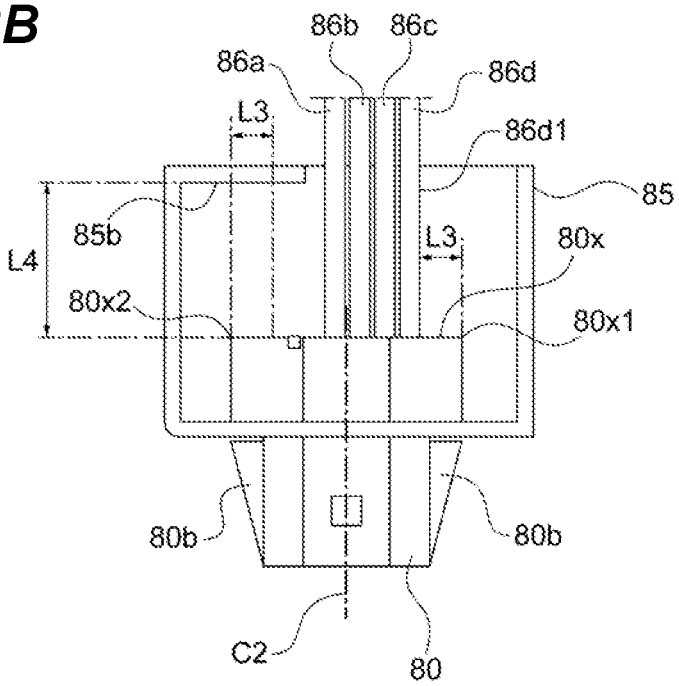

Next, a method for attaching the connector 80 to the holder 85 will be described. FIG. 13A is a top view of the connector 80 and the holder 85 while the connector 80 is being attached. FIG. 13B is a top view of the connector 80 and the holder 85 after attaching the connector 80.

As illustrated in FIG. 13A, when attaching the connector 80 to the holder 85, the operator first moves the connector 80 to the position of the fitting hole 85*a* inside the holder 85. Next, the operator presses in the connector 80 in the direction of the arrow V2 illustrated in FIG. 13A up to a position in which butting portions 80*d* of the connector 80 butt against the holder 85.

Thus, the insertion opening 80*a* in the connector 80 is exposed via the fitting hole 85*a* to the outside of the holder 85, and the connector 80 is fitted into the fitting hole 85*a*. At such time, the retaining portion 80*b* of the connector 80 is compressed through elastic deformation while abutting the inner wall of the fitting hole 85*a*, and when the connector 80 moves to the position in which same is fitted into the fitting hole 85*a*, the retaining portion 80*b* is restored so as to abut the surface where the fitting hole 85*a* in the holder 85 is formed. The retaining portion 80*b* thus regulates disengagement of the connector 80 fitted in the fitting hole 85*a*. The connector 80 is thus attached.

Here, when the connector 80 is fitted into the fitting hole 85*a*, the cable 86*d*, which is positioned farthest from the center of the connector 80 in the direction of the arrow K3, is positioned more toward the center of the connector 80 than an end portion 80*x*1 of the end surface 80*x* of the connector 80 on the cable 86*d* side. The distance, in the direction of the arrow K4, between the end portion 80*x*1 of the end surface 80*x* of the connector 80 on the cable 86*d* side and an end surface 86*d* 1 of the cable 86*d* is L3. Note that line C2 illustrated in FIG. 13B is the center line of the connector 80 in the direction of the arrow K4.

Furthermore, when the connector 80 is fitted in the fitting hole 85*a*, the rib 85*b* extends toward the center of the connector 80 in the direction of the arrow K4 by a distance greater than or equal to a distance L3 from the position in which the end portion 80*x*1 of the end surface 80*x* of the connector 80 opposes the end portion 80*x*2. Moreover, the rib 85*b* is disposed in a position between, in the direction of the arrow K3, the end surface 80*x* of the connector 80 and a position separated by a distance L4 from the end surface 80*x* in the direction of separation from the connector 80. In this embodiment, L4 is set to equal 15 mm.

Figure 14:
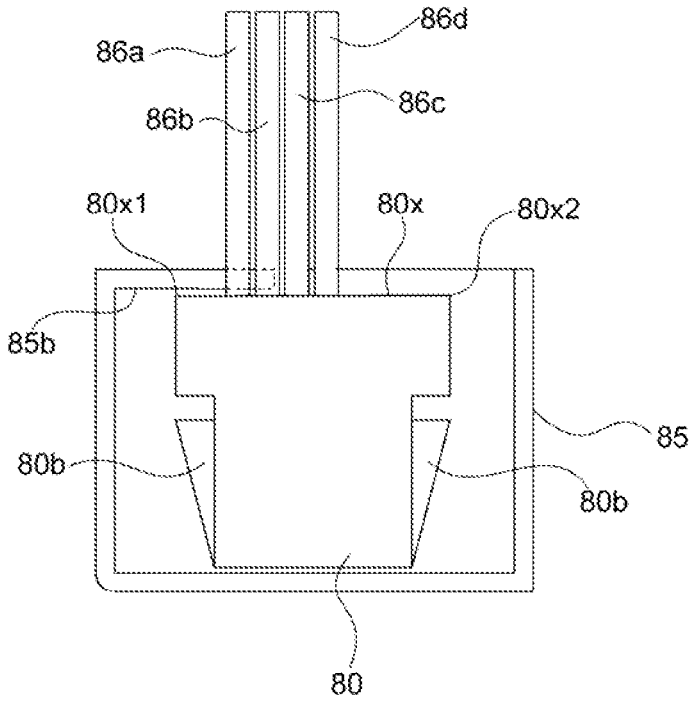
FIG. 14 is a top view of the connector and the holder.

By disposing the rib 85*b* in such a position, the cable 86*d* interferes with the rib 85*b* when an attempt is made to fit the connector 80 into the fitting hole 85*a* in the holder 85 with an orientation which is the opposite of the intended orientation, as illustrated in FIG. 14. Hence, it is not possible to move the connector 80 up to the position of the fitting hole 85*a*, and it is not possible to attach the connector 80. Note that, when an attempt is made to forcibly move the connector 80 up to the position of the fitting hole 85*a*, a large load is brought to bear on the cable 86*d*, and the cable 86*d* will likely be broken. It is therefore possible to prevent the connector 80 from being attached with an orientation which is the opposite of the intended orientation. Hence, difficulty with the insertion of another connector into the connector 80 can be suppressed at the time of insertion, and it is possible to suppress reduced workability during assembly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-041248, filed Mar. 10, 2020, which is hereby incorporated by reference herein in its entirety.

What is claimed is:

1. A sheet conveying apparatus, comprising:

a rocker switch that switches on and off a power supply of the sheet conveying apparatus or of a member installed in the sheet conveying apparatus, the rocker switch having three terminals and an operation portion that is pressed down so as to swing between an on side and an off side;

a plurality of connectors each connected to two of the three terminals of the rocker switch;

an outer cover of the sheet conveying apparatus, the outer cover being provided with a mark indicating the on and/or off of the power supply of the rocker switch; and a housing portion in which the rocker switch is housed, the housing portion having a fitting hole into which the rocker switch is fitted and a wall portion which is disposed, in the direction of insertion of the plurality of connectors into the two terminals, so as to oppose a surface in which the fitting hole is formed and so as to oppose an end surface of the rocker switch on the opposite side from the side where the operation portion is disposed.

2. A sheet conveying apparatus, comprising:

a rocker switch that switches on and off a power supply of the sheet conveying apparatus or of a member installed in the sheet conveying apparatus, the rocker switch having three terminals and an operation portion that is pressed down so as to swing between an on side and an off side;

a plurality of connectors each connected to two of the three terminals of the rocker switch;

an outer cover of the sheet conveying apparatus, the outer cover being provided with a mark indicating the on and/or off of the power supply of the rocker switch; and a housing portion in which the rocker switch is housed, the housing portion having a fitting hole into which the rocker switch is fitted and a wall portion which is disposed, in the direction of insertion of the plurality of connectors into the two terminals, so as to oppose a surface in which the fitting hole is formed and so as to oppose an end surface of the rocker switch on the opposite side from the side where the operation portion is disposed, wherein the wall portion extends toward the center of a rocker switch from a position opposing the end portion of the rocker switch opposing the end portion on the opposite side from the end portion of the end surface of the rocker switch which is on the connector side by a distance greater than or equal to the distance, in a parallel direction of the two terminals, between the connector among the plurality of connectors which is farthest from the center of the rocker switch and the end portion of the end surface of the rocker switch which is on the connector side, and wherein the wall portion is disposed in a position closer, in the insertion direction, to the rocker switch than the end surfaces of the plurality of connectors on the opposite side from the side where the rocker switch is disposed.

3. The sheet conveying apparatus according to claim 2, comprising:

a sheet cassette that stores a sheet that has an image formed thereon; and a heater that heats the sheet stored in the sheet cassette, wherein the rocker switch switches on and off a power supply of the heater.

4. A sheet conveying apparatus, comprising:

a rocker switch that switches on and off a power supply of the sheet conveying apparatus or of a member installed in the sheet conveying apparatus, the rocker switch having three terminals and an operation portion that is pressed down so as to swing between an on side and an off side;

a plurality of connectors connected to two of the three terminals of the rocker switch;

an outer cover of the sheet conveying apparatus, the outer cover being provided with a mark indicating the on and/or off of the power supply of the rocker switch; and a housing portion in which the rocker switch is housed, the housing portion having a fitting hole into which the rocker switch is fitted and a wall portion which is disposed, in the direction of insertion of the plurality of connectors into the two terminals, so as to oppose a surface in which the fitting hole is formed and so as to oppose an end surface of the rocker switch on the opposite side from the side where the operation portion is disposed, wherein the connector among the plurality of connectors which is positioned farthest from a center of the rocker switch in a parallel direction of the two terminals protrudes toward an end portion of the end surface of the rocker switch which is on the connector side, and wherein the wall portion is disposed in a position opposing an end portion on the opposite side from the end portion of the end surface of the rocker switch in the parallel direction of the two terminals and in a position closer, in the insertion direction, to the rocker switch than end surfaces of the plurality of connectors on the opposite side from the side where the rocker switch is disposed.

5. The sheet conveying apparatus according to claim 4, wherein the rocker switch comprises a restricting portion that includes an elastic body, that abuts the surface of the housing portion in which the fitting hole is formed, and that regulates disengagement of the rocker switch fitted in the fitting hole.

6. The sheet conveying apparatus according to claim 4, comprising:

a sheet cassette that stores a sheet that has an image formed thereon; and a heater that heats the sheet stored in the sheet cassette, wherein the rocker switch switches on and off a power supply of the heater.

7. The sheet conveying apparatus according to claim 4, wherein the operation portion is provided, on the side where the mark is disposed in the parallel direction of the two terminals, with another mark that indicates the direction in which the operation portion is pressed in when switching on or off the power supply of the rocker switch.

8. The sheet conveying apparatus according to claim 7, wherein a recess, which is recessed on the side where the other mark is disposed, is formed in an inner wall of the fitting hole in the parallel direction of the two terminals.

9. A sheet conveying apparatus, comprising:

a rocker switch that switches on and off a power supply of the sheet conveying apparatus or of a member installed in the sheet conveying apparatus, the rocker switch having three terminals and an operation portion that is pressed down so as to swing between an on side and an off side;

a connector connected to two among the three terminals of the rocker switch and respectively provided to end portions of a plurality of cables;

an outer cover of the sheet conveying apparatus, the outer cover being provided with a mark indicating the on and/or off of the power supply of the rocker switch; and a housing portion in which the rocker switch is housed, the housing portion having a fitting hole into which the rocker switch is fitted and a wall portion which is disposed, in the direction of insertion of the plurality of connectors into the two terminals, so as to oppose a surface in which the fitting hole is formed and so as to oppose the end surface of the rocker switch on the opposite side from the side where the operation portion is disposed, wherein the connector among the plurality of connectors which is positioned farthest from the center of the rocker switch in a parallel direction of the two terminals protrudes toward an end portion of the end surface of the rocker switch which is on the connector side, and wherein the wall portion is disposed in a position opposing an end portion on the opposite side from the end portion of the end surface of the rocker switch in the parallel direction of the two terminals and in a position between the end surfaces of the plurality of connectors on the opposite side from the side where the rocker switch is disposed in the insertion direction, and a position separated by 15 mm from the end surfaces in the direction of separation from the rocker switch.

10. The sheet conveying apparatus according to claim 9, wherein the rocker switch comprises a restricting portion that includes an elastic body, that abuts the surface of the housing portion in which the fitting hole is formed, and that regulates disengagement of the rocker switch fitted in the fitting hole.

11. The sheet conveying apparatus according to claim 9, wherein the operation portion is provided, on the side where the mark is disposed in the parallel direction of the two terminals, with another mark that indicates the direction in which the operation portion is pressed in when switching on or off the power supply of the rocker switch.

12. The sheet conveying apparatus according to claim 11, wherein a recess, which is recessed on the side where the other mark is disposed, is formed in an inner wall of the fitting hole in the parallel direction of the two terminals.

13. The sheet conveying apparatus according to claim 9, comprising:

a sheet cassette that stores a sheet that has an image formed thereon; and a heater that heats the sheet stored in the sheet cassette, wherein the rocker switch switches on and off a power supply of the heater.

14. The sheet conveying apparatus according to claim 13, wherein the rocker switch comprises a restricting portion that includes an elastic body, that abuts the surface of the housing portion in which the fitting hole is formed, and that regulates disengagement of the rocker switch fitted in the fitting hole.

15. The sheet conveying apparatus according to claim 13, wherein the operation portion is provided, on the side where the mark is disposed in the parallel direction of the two terminals, with another mark that indicates the direction in which the operation portion is pressed in when switching on or off the power supply of the rocker switch.

16. The sheet conveying apparatus according to claim 15, wherein a recess, which is recessed on the side where the other mark is disposed, is formed in an inner wall of the fitting hole in the parallel direction of the two terminals.

* * * * *